United States Patent [19]

Muzyka et al.

[11] 3,972,713

[45] Aug. 3, 1976

[54] SULFIDATION RESISTANT NICKEL-IRON BASE ALLOY

[75] Inventors: Donald R. Muzyka; Clyde Raymond Whitney, both of Reading, Pa.

[73] Assignee: Carpenter Technology Corporation, Reading, Pa.

[22] Filed: Sept. 30, 1974

[21] Appl. No.: 510,621

Related U.S. Application Data

[63] Continuation-in-part of Ser. No. 474,418, May 30, 1974, abandoned, which is a continuation-in-part of Ser. No. 381,761, July 23, 1973, abandoned.

[52] U.S. Cl. ..... 75/171; 148/32.5; 148/162

[51] Int. Cl.[2] ..... C22C 19/05

[58] Field of Search ..... 75/171, 170; 148/32, 148/32.5, 162

[56] References Cited

UNITED STATES PATENTS

| | | | |
|---|---|---|---|
| 2,570,193 | 10/1951 | Bieber et al. | 75/171 |
| 3,573,901 | 4/1971 | Economy | 75/171 |

*Primary Examiner*—R. Dean
*Attorney, Agent, or Firm*—Edgar N. Jay

[57] ABSTRACT

A sulfidation-resistant alloy having high stress-rupture strength at about 1350°–1500°F, containing about 0.02–0.08% carbon, 21–26% chromium, 52–58% nickel, 1–3.5% molybdenum, 1.75–3.25% titanium, 0.75–2.25% aluminum, 0.50–2.00% columbium, up to 0.02% boron and the balance iron.

18 Claims, 3 Drawing Figures

SULFIDATION RESISTANT NICKEL-IRON BASE ALLOY

CROSS REFERENCES

This is a continuation-in-part of our copending application filed May 30, 1974, Ser. No. 474,418, now abandoned which is a continuation-in-part of our then copending application filed July 23, 1973, Ser. No. 381,761, assigned to the assignee of the present application, and now abandoned.

BACKGROUND OF THE INVENTION

This invention relates to nickel-iron base alloys, and, more particularly, to an alloy containing nickel, iron, chromium, molybdenum, titanium, aluminum and columbium critically balanced to provide good sulfidation resistance combined with a high degree of hot strength at elevated temperatures in the heat treated condition.

A number of alloys have hitherto been developed which were suitable for use under conditions requiring good hot strength and corrosion resistance at the elevated temperatures encountered in internal combustion engines. With the increasing use of fuels containing larger amounts of sulfur, it is becoming more important that such alloys also have good resistance to sulfidation. Thus, at the present time, heavy duty diesel engines, which may burn high sulfur content fuels, require valves and valve components made of an alloy which not only has good hot strength at operating temperatures of up to about 1500°F, but also has high resistance to sulfidation at such elevated temperatures. Alloy A, having a nominal composition of about 15% chromium, 7% iron, 2.5% titanium, 1% aluminum, 1% columbium and the balance nickel, has been used as a valve alloy for diesel engines because of its high strength in the 1300°–1500°F temperature range. However, as the sulfur content of fuel has increased, Alloy A has shown poor resistance to sulfidation attack. This is a type of corrosion in which sulfides form at the surface of the alloy part, and, especially when chromium is removed from the alloy matrix by this sulfidation corrosion, can result in the catastrophic failure of the part.

Alloy B, having desirable properties for use under stress in a sulfur-bearing atmosphere at elevated temperatures has a nominal composition of about 0.05% carbon, 0.30% manganese, 0.20% silicon, 29% chromium, 46% nickel, 20% cobalt, 2.30% titanium, 1.20% aluminum, 0.70% columbium, 0.006% boron and 0.50% maximum iron. The good hot strength at elevated temperatures and high resistance to sulfidation exhibited by this alloy make it especially desirable for use in making valves for diesel engines. However, the high percentage of cobalt and the relatively high expense involved in using iron-free alloying additions make this alloy relatively expensive.

Alloy C has a nominal composition of about 27% chromium, 37% nickel, 8% manganese, 2% titanium, 1% aluminum and 25% iron. This alloy is more resistant than Alloy A to sulfidation attack, but has a much lower strength in the 1300°–1500°F temperature range. For this reason, Alloy C is not a good material for parts which must operate at such temperatures in diesel engines.

SUMMARY OF THE INVENTION

It is, therefore, a principal object of this invention to provide an alloy which has high strength and good resistance to sulfidation.

A more specific object is to provide a nickel-iron base alloy for making valves and valve components for use in heavy duty diesel engines and which is especially resistant to attack by sulfidation which occurs when high sulfur content fuels are used.

BRIEF DESCRIPTION OF THE DRAWING

The foregoing, as well as additional objects and advantages of the present invention will be apparent from the following description of a preferred embodiment of this invention and the accompanying drawing in which.

DESCRIPTION OF THE PREFERRED EMBODIMENT

Figure 1:
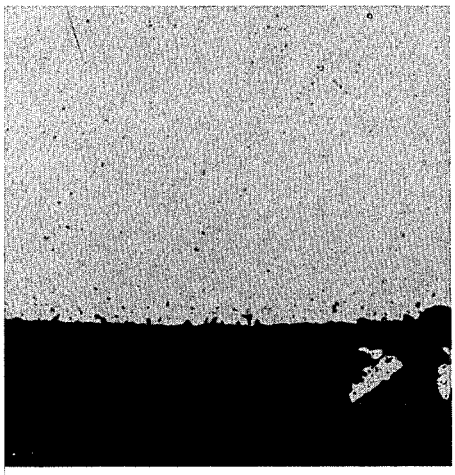
FIG. 1 is a micrograph prepared from a specimen made from the alloy of the present invention, and which has undergone sulfidation resistance test.

In accordance with the present invention, there is provided an alloy which consists essentially of the following elements in about the amounts indicated in the broad and preferred ranges given in approximate weight percent below. It is to be noted that it is not intended to be limited by the form of the following tabulation which has been used for convenience. It is intended that the upper and/or lower limits of one or more of the elements included in the broad range can be used with the upper and/or lower limits of one or more of the elements as included in the preferred range.

| | Broad | Intermediate | Preferred |
|---|---|---|---|
| C | 0.02–0.08 | 0.04–0.065 | 0.04–0.065 |
| Mn | 2 Max. | 0.25 Max. | 0.20 Max. |
| Si | 0.25 Max. | 0.20 Max. | 0.20 Max. |
| P | 0.03 Max. | 0.02 Max. | 0.015 Max. |
| S | 0.03 Max. | 0.02 Max. | 0.015 Max. |
| Cr | 21–26 | 22.0–24.5 | 22.0–23.5 |
| Ni | 52–58 | 53–56 | 54–56 |
| Mo | 1–3.5 | 1.5–2.5 | 1.5–2.5 |
| Ti | 1.75–3.25 | 2.25–2.75 | 2.25–2.75 |
| Al | 0.75–2.25 | 1.25–1.75 | 1.25–1.75 |
| Cb | 0.50–2 | 0.75–1.50 | 0.75–1.50 |
| B | up to 0.02 | 0.002–0.008 | 0.002–0.008 |

The balance of the composition is iron, except for incidental impurities which, preferably, are kept low. The elements manganese, silicon, phosphorus and sulfur are impurities which should be present, preferably in the smallest amounts possible. Particularly, silicon is kept below about 0.25%, or preferably below about 0.20% since higher amounts adversely affect the mechanical properties of the alloys. For best mechanical properties, particularly stress rupture life and ductility, manganese is kept below about 0.25% and better yet below about 0.20%. However, when the use for which the alloy is intended does not preclude it, then larger amounts of manganese up to about 1% and even up to about 2% can be present. Phosphorus and sulfur may be present as incidental impurities. They should be limited to about 0.03% each because greater amounts adversely affect the mechanical properties, cleanliness, and forgeability of the alloy. Better yet, phosphorus and sulfur should be limited to 0.02% maximum and for best results to 0.015% maximum.

In the alloy of this invention, a minimum of about 0.02% carbon is required to provide the desired deoxidation and the desired formation of carbides in the grain boundaries during aging. Carbon ranging from about 0.04–0.065% is preferred. Because the main strengthening reaction of this alloy is the formation of gamma prime which is believed to be mainly composed of $Ni_3(Al,Ti)$, excessive carbon tends to detract from the strength of this alloy by tying up titanium. Therefore, no more than about 0.08% carbon should be present.

A minimum of about 21% chromium is required to provide the desired sulfidation resistance, particularly necessary in the environment to which valves are exposed in heavy duty diesel engine cylinders where sulfur-containing fuel oil is combusted. Too much chromium results in the formation of a chromium-rich phase, tentatively identified as a body centered cubic alpha phase, too much of which adversely affects the elevated temperature stress rupture life as well as the ductility at room temperature. Therefore, the chromium content is limited to about 26%, and is preferably kept in the range from about 22.0–24.5%.

Nickel is required to minimize the presence of phases other than the desired austenite and to take part in the reaction by which the alloy attains its desired strength. A minimum of about 52%, or preferably about 53–56%, is used for this purpose, while beyond about 58%, larger amounts of nickel will needlessly increase the cost of the alloy without providing any significant offsetting advantages.

For best all-around properties, that is, microstructural stability, sulfidation resistance and mechanical properties, the chromium and nickel contents are adjusted to about 22–23.5% chromium and about 54–56% nickel.

Molybdenum acts as a solid solution strengthener and, for this purpose is present from about 1–3.5%, preferably 1.5–2.5%. When present in amounts above about 3.5%, molybdenum may have an adverse effect on the sulfidation resistance and hot workability of the alloy.

As was noted, titanium is required for the formation of the gamma prime phase by which this alloy is strengthened, and, for this purpose, there should be at least about 1.75%. However, more than about 3.25% may adversely affect the hot workability of the alloy. Preferably, the titanium is present in the range of about 2.25–2.75%.

Aluminum, which also takes part in the main strengthening reaction, should be present in the amount of at least about 0.75% to ensure that the gamma prime phase is stable at such elevated temperatures as 1300°–1500°F, and the preferred range for aluminum is about 1.25.–1.75%. Best results are obtained when the titanium/ aluminum ratio is greater than 1.0. More than about 2.25% aluminum adversely affects the hot workability of the alloy.

To form stable carbides which nucleate early in the solidification process, columbium is added, usually in amounts about 10 to 12 times the percent carbon present. A minimum of about 0.50% columbium is used, and, preferably about 0.75–1.50%. More columbium than that which forms carbides can be tolerated, and some small amount of columbium may be in the gamma prime phase, but above a total of about 2% merely adds to the cost of the alloy.

A small amount of boron, up to about 0.02%, contributes to the improved elevated temperature stress rupture life and ductility of ths alloy. Preferably at least 0.002% is used, and best results are obtained with about 0.004–0.008%.

The alloy of this invention can be prepared using conventional practices, but it is preferably melted and cast into ingots by a multiple melting technique. For example, a heat can be first melted and cast as an ingot under vacuum in an induction furnace, and then that ingot used as a consumable electrode and remelted under vacuum. Alternatively, an electroslag remelting technique can be used.

The alloy is forged from a furnace temperature above about 1900°F, preferably from about 2100° to 2150°F, followed by solution treatment of about 1875° to 2100°F for about 1 to 4 hours, or longer if necessary, preferably at about 2000°F for 4 hours. After quenching in oil, or faster if desired, the alloy is aged by heating at about 1200° to 1550°F about 16 to 48 hours. Preferably aging is carried out at about 1300°F for 24 hours, but other aging treatments can be used including double aging treatments. By double aging is meant aging for about 2 to 8 hours near the upper end of the range, followed by a final age for about 16 to 48 hours at a temperature near the lower end of the 1200°–1550°F range. As solution treated and aged, the alloy is fully austenitic.

The heat treatment of this alloy brings out a gamma prime phase which is a face centered cubic (FCC) structure, which helps give the alloy its good strength in the temperature range of 1300° to 1500°F. There may also be a small amount of chromium righ alpha phase which is a body centered cubic structure similar to ferrite. Excessive amounts of this phase adversely affect room temperature ductility as measured by percent elongation in room temperature tensile tests.

As a further illustration of the present invention, two experimental vacuum induction heats, Examples 1 and 2, were prepared having compositions in accordance with this invention. The ingot of Example 2 was remelted as a consumable electrode under vacuum. For comparison, small heats of prior Alloys, A, B and C were prepared as was Example 1. The compositions of these five heats are given in Table I.

TABLE I

| | Ex. 1 | Ex. 2 | A | B | C |
|---|---|---|---|---|---|
| C | .063 | .062 | .03 | .09 | .055 |
| Mn | .17 | .17 | .05 | .35 | 8.11 |
| Si | .17 | .17 | .05 | .16 | .10 |
| P | <.005 | <.005 | .006 | <.005 | <.005 |
| S | .006 | .003 | .003 | .005 | .008 |
| Cr | 23.30 | 23.78 | 15.63 | 28.39 | 26.86 |
| Ni | 54.13 | 54.84 | Bal. | Bal. | 37.50 |
| Co | — | — | — | 19.45 | — |

TABLE I-continued

| | Ex. 1 | Ex. 2 | A | B | C |
|---|---|---|---|---|---|
| Mo | 2.03 | 1.87 | — | — | — |
| Ti | 2.55 | 2.50 | 2.49 | 2.28 | 1.97 |
| Al | 1.43 | 1.48 | 1.18 | 1.16 | .99 |
| Cb | 1.02 | .99 | 1.01 | .63 | — |
| B | .0062 | .0053 | .0024 | .0057 | .0056 |
| Fe | Bal. | Bal. | 7.65 | .90 | Bal. |

In each instance, the balance was iron or nickel, as indicated, except for incidental impurities.

To demonstrate and compare the sulfidation resistance of the alloys, specimens of Examples 1 and 2 and Alloys A, B and C were machined from forgings to provide 0.300 in. diameter, 0.750 in. long cylinders. Each was heat treated as shown in Table II.

TABLE II

| | Sol. Treat. | | | Aging | | | | | |
|---|---|---|---|---|---|---|---|---|---|
| | Temp | Time | | Primary | | | Final | | |
| | (°F) | (hrs) | Cool[1] | °F | hrs | Cool | °F | hrs | Cool |
| Ex. 1 | 2000 | 4 | OQ | 1500 | 4 | AC | 1350 | 24 | AC |
| Ex. 2 | 2000 | 4 | OQ | — | — | — | 1300 | 24 | AC |
| A | 2100 | 4 | OQ | 1550 | 24 | AC | 1300 | 20 | AC |
| B | 1975 | 8 | AC | — | — | — | 1300 | 16 | AC |
| C | 2100 | 4 | OQ | — | — | — | 1300 | 24 | AC |

[1]OQ — oil quenched AC — air cooled

The specimens were placed vertically in 1-inch diameter crucibles containing 7.0 grams of a molten salt mixture of 90% $Na_2SO_4$ and 10% NaCl, and allowed to stand for 100 hours at 1700°F exposed to an air atmosphere. Then the samples were removed, and examination clearly demonstrated that only the specimens of Examples 1 and 2 and Alloy B had good resistance to sulfidation. In order to prepare micrographs of the tested specimens of Example 1, Alloy B and Alloy C, cross-sectional slices were taken at the height of the air/salt interface and mounted on plastic supports. Optical micrographs at 100× magnification were then taken of the outer edge of each slice and are shown respectively in FIGS. 1, 2, and 3.

Figure 2:
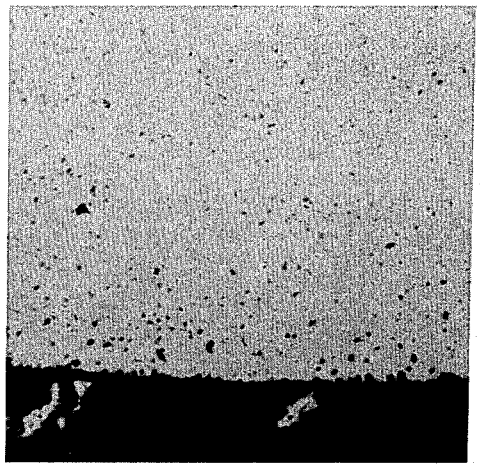
FIG. 2 is a similar micrograph of a specimen made of Alloy B.
Figure 3:
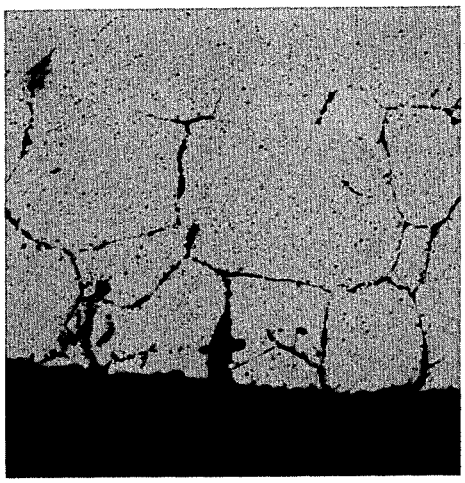
FIG. 3 is a similar micrograph of a specimen made of Alloy C.

No micrograph was prepared from the specimen of Alloy A because it was catastrophically attacked by the hot salt. The micrographs of FIGS. 1 and 2 show that the specimens of Example 1 and Alloy B were attacked only slightly, if at all, by the molten salt. On the other hand, the micrograph of FIG. 3 shows that Alloy C suffered severe intergranular attack. These accelerated sulfidation tests clearly show that the alloy of the present invention has about the same resistance to sulfur attack as Alloy B and much greater resistance than Alloy C.

Standard A.S.T.M. stress rupture test specimens and tensile test specimens were prepared from each of the analyses of Table I except that tensile tests were not carried out in the case of Example 1 and, in the case of Alloy C, because the stress rupture life obtained was so low. Heat treatment of the specimens was as indicated in Table II. Stress rupture testing was carried out at 1350°F under a load of 50,000 psi (50 ksi) and at 1500°F under a load of 30,000 psi (30 ksi), and the results are given in Table III. In each case, the duration of the test before failure is indicated in hours (hrs) under "Life", and percent elongation (El. %) and percent reduction in area (R.A. %) are also given. In Table IV, the results of tensile tests carried out at 70°F and 1500°F are indicated. In each instance, after the test temperature there is indicated the ultimate tensile strength (U.T.S.) followed by 0.2% yield strength (Y.S.), percent elongation and percent reduction in area.

TABLE III

| | Stress Rupture Data | | | | | |
|---|---|---|---|---|---|---|
| | 1350°F/50 ksi | | | 1500°F/30 ksi | | |
| | Life (hrs) | El. (%) | R.A. (%) | Life (hrs) | El. (%) | R.A. (%) |
| Ex. 1 | 129 | 9.5 | 12.4 | 99.7 | 9.4 | 10.0 |
| Ex. 2 | 133.2 | 4.5 | 4.4 | 61.2 | 3.9 | 7.7 |
| Alloy A | 100.0 | 8.0 | — | — | — | — |
| Alloy B | 198.5 | 6.9 | 6.9 | 110.4 | 7.6 | 15.2 |
| Alloy C | 1.3 | 1.9 | 2.0 | 1.9 | 6.7 | 7.6 |

TABLE IV

| | Tensile Data | | | | |
|---|---|---|---|---|---|
| | Test Temp. °F | U.T.S. (ksi) | .2%Y.S. (ksi) | El. % | R.A. % |
| Ex. 2 | 70 | 175 | 111 | 30.6 | 38.2 |
| Alloy A | " | 153 | 89 | 23 | 25 |
| Alloy B | " | 183 | 120 | 30 | 41 |
| Ex. 2 | 1500 | 104.5 | 91.5 | 12.4 | 14 |
| Alloy A | " | 80 | 70 | 25 | 33 |

TABLE IV-continued

| | Test Temp. °F | Tensile Data U.T.S. (ksi) | .2%Y.S. (ksi) | El. % | R.A. % |
|---|---|---|---|---|---|
| Alloy B | " | 109 | 92 | 11 | 14 |

An additional stress rupture specimen of Example 1, when aged by a single instead of a double heat treatment, had a stress rupture life at 1350°F under 50 ksi of 277.6 hours, with a 7.4% elongation and a 12.4% reduction in area. Because of its combination of hgh strength at elevated temperatures and good resistance to sulfidation, the alloy of this invention is particularly well suited for use in the fabrication of parts which must withstand stress and sulfur-bearing corrosive atmospheres at elevated temperatures. This alloy is considerably less expensive than Alloy B because Alloy B contains about 20% cobalt and must be made with the more expensive iron-free forms of the alloying elements.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A nickel-iron base alloy which is resistant to sulfidation at elevated temperatures in the range of about 1300° to 1500°F and which has good hot strength and stress rupture life at elevated temperatures up to about 1500°F when heat treated, which consists essentially by weight of about

| | Percent |
|---|---|
| Carbon | 0.02–0.08 |
| Manganese | 2 Max. |
| Silicon | 0.25 Max. |
| Phosphorus | 0.03 Max. |
| Sulfur | 0.03 Max. |
| Chromium | 21–24.5 |
| Nickel | 52–58 |
| Molybdenum | 1–3.5 |
| Titanium | 1.75–3.25 |
| Aluminum | 0.75–2.25 |
| Columbium | 0.50–2 |
| Boron | up to 0.02 |

and the balance being essentially iron and incidental impurities.

2. The nickel-iron base alloy set forth in claim 1 containing about 0.02% maximum phosphorus and 0.02% maximum sulfur.

3. The nickel-iron base alloy set forth in claim 2 containing about 0.002–0.008% boron.

4. The nickel-iron base alloy set forth in claim 2 containing about 0.004–0.008% boron.

5. The nickel-iron base alloy set forth in claim 3 containing about 0.04–0.065% carbon.

6. The nickel-iron base alloy set forth in claim 3 containing about 22.0–24.5% chromium.

7. The nickel-iron base alloy set forth in claim 3 containing about 1.5–2.5% molybdenum.

8. The nickel-iron base alloy set forth in claim 3 containing about 2.25–2.75% titanium and about 1.25–1.75% aluminum.

9. The nickel-iron base alloy set forth in claim 3 in which the ratio of titanium to aluminum is greater than 1.0.

10. The nickel-iron base alloy set forth in claim 3 containing about 53–56% nickel.

11. The nickel-iron base alloy set forth in claim 3 containing about 0.75–1.50% columbium.

12. The nickel-iron base alloy set forth in claim 1 containing about

| | Percent |
|---|---|
| Carbon | 0.04–0.065 |
| Manganese | 0.25 Max. |
| Silicon | 0.20 Max. |
| Phosphorus | 0.02 Max. |
| Sulfur | 0.02 Max. |
| Chromium | 22.0–24.5 |
| Nickel | 53–56 |
| Molybdenum | 1.5–2.5 |
| Titanium | 2.25–2.75 |
| Aluminum | 1.25–1.75 |
| Columbium | 0.75–1.50 |
| Boron | 0.002–0.008. |

13. The nickel-iron base alloy set forth in claim 12 containing about 0.015 maximum phosphorus and 0.015 sulfur.

14. The nickel-iron base alloy set forth in claim 12 containing about 0.004–0.008% boron.

15. The nickel-iron base alloy set forth in claim 14 containing about

| | Percent |
|---|---|
| Carbon | .063 |
| Chromium | 23.30 |
| Nickel | 54.13 |
| Molybdenum | 2.03 |
| Titanium | 2.55 |
| Aluminum | 1.43 |
| Columbium | 1.02 |
| Boron | .0062. |

16. The nickel-iron base alloy set forth in claim 14 containing about

| | Percent |
|---|---|
| Carbon | .062 |
| Chromium | 23.78 |
| Nickel | 54.84 |
| Molybdenum | 1.87 |
| Titanium | 2.50 |
| Aluminum | 1.48 |
| Columbium | .99 |
| Boron | .0053. |

17. The nickel-iron base alloy set forth in claim 12 containing about

| | Percent |
|---|---|
| Manganese | 0.20 Max. |
| Chromium | 22–23.5 |
| Nickel | 54–56. |

18. The nickel-iron base alloy set forth in claim 1 containing from 21% to about 23.5% chromium.

* * * * *